US005421178A

United States Patent [19]

Hamel et al.

[11] Patent Number: 5,421,178

[45] Date of Patent: Jun. 6, 1995

[54] MOTORIZED LOCK ACTUATOR FOR CYLINDRICAL LOCKSET

[75] Inventors: Lyn E. Hamel, Anderson; Charles T. Weindorf, Jr., Indianapolis, both of Ind.

[73] Assignee: Best Lock Corporation, Indianapolis, Ind.

[21] Appl. No.: 5,625

[22] Filed: Jan. 19, 1993

[51] Int. Cl.[6] ..... E05B 47/06; E05B 55/04

[52] U.S. Cl. ..... 70/283; 80/277; 80/224; 80/472; 292/144; 292/DIG. 27

[58] Field of Search ..... 70/277, 279, 283, 218, 70/223, 224, 149, 467, 472, 474, 476; 292/DIG. 27, 144, 347, 352, 359

[56] References Cited

U.S. PATENT DOCUMENTS

| | | | |
|---|---|---|---|
| 2,702,466 | 2/1955 | McConnell | 70/474 X |
| 3,105,712 | 10/1963 | Duvall | 70/476 X |
| 3,425,742 | 2/1969 | Rauber, Jr. | 292/144 X |
| 3,894,417 | 7/1975 | Taniyama . | |
| 3,939,679 | 2/1976 | Barker et al. . | |
| 3,955,387 | 5/1976 | Best et al. . | |
| 4,073,527 | 2/1978 | Schlage . | |
| 4,135,377 | 1/1979 | Kleefeldt et al. | 292/144 X |
| 4,671,087 | 6/1987 | Olenfalk et al. . | |
| 4,736,970 | 4/1988 | McGourty et al. . | |
| 4,799,719 | 1/1989 | Wood | 292/144 |
| 4,920,773 | 5/1990 | Surko, Jr. . | |
| 4,993,757 | 2/1991 | Corzine | 292/144 |
| 5,018,375 | 5/1991 | Tully . | |
| 5,083,122 | 1/1992 | Clark . | |

*Primary Examiner*—Peter M. Cuomo
*Assistant Examiner*—Suzanne L. Dino
*Attorney, Agent, or Firm*—Barnes & Thornburg

[57] ABSTRACT

A device is provided for use in actuating a locking lug in a cylindrical lockset. The device includes a mechanism for moving the locking device between door handle locking and unlocking positions. The moving mechanism includes a plunger having an axis, a locking-assist spring coupled to the plunger and the locking lug, and a mechanism for reciprocating the plunger along its axis in opposite directions. To lock the cylindrical lockset, the reciprocating mechanism moves the plunger along its axis in a locking direction against the locking-assist spring so that the locking-assist spring is moved toward the locking lug to urge the locking lug to its door handle-locking position. To unlock the cylindrical lockset, the reciprocating mechanism moves the plunger along its axis in an opposite, unlocking direction away from the locking lug so that the locking lug is allowed to move to its door handle-unlocking position.

50 Claims, 7 Drawing Sheets

10
12
20
22
24
26
28
30
32
34
36
40
48
50
52
54
56
58
60
62
64
68
74
78
82
86
88
90
92
94
96
110
112
114
116
117
118
120
122
124
126
128
130
132
134
136
138
140
142

MOTORIZED LOCK ACTUATOR FOR CYLINDRICAL LOCKSET

BACKGROUND AND SUMMARY OF THE INVENTION

This invention relates to a cylindrical lockset for operating a latch bolt retractor assembly mounted in a door, and particularly to a motorized lock actuator for electrically locking and unlocking the cylindrical lockset. More particularly, this invention relates to a door-mounted cylindrical lockset having an outside door handle that can be locked against rotation using an electromechanical lock actuator mechanism mounted in the lockset, thereby preventing an intruder from opening the door by rotating the outside handle to retract a latch bolt mounted in the door and connected to the lockset.

Cylindrical locksets are well known and such a lockset is operated to lock and unlock a door by rotating inside and outside door knobs or lever handles connected to the lockset. Typically, a cylindrical lockset is used to connect a door handle to a retractable latch bolt. Each cylindrical lockset can include various mechanical linkages and locking mechanisms of the types described in the following paragraphs.

In use, a user can often rotate either the inside or outside door handle to operate the mechanical linkage mounted inside the lockset. This enables the user to retract a spring-biased latch bolt connected to the cylindrical lockset from a projected position extending outside the door and engaging a side slot formed in a door-jamb to a retracted position inside the door. The user is now free to swing the door on its hinges from a closed position to an opened position.

A locking mechanism of some kind is usually mounted in the cylindrical lockset. Such a locking mechanism is often actuated using a key or a button to lock or unlock the outside door handle. Typically, the locking mechanism is configured so that it can be actuated either by turning a key inserted into a keyway formed in the outside door handle or by turning or pushing a button mounted in the inside door handle. For example, cylindrical locksets using mechanical locking mechanisms are disclosed in U.S. Pat. Nos. 3,955,387 to Walter E. Best et al and 4,437,695 to William R. Foshee. Each of these locksets include a spring-loaded mechanical locking bar and turn button. The turn button is mounted in the inside doorknob and is operable to allow a user to actuate the mechanical locking bar and thereby control locking and unlocking of the outside doorknob.

It is also known to use a miniature motor and locking linkage mounted inside a cylindrical lockset to control locking and unlocking of the outside doorknob or handle. See, for example, U.S. Pat. Nos. 5,083,122 to Keith S. Clark and 5,018,375 to Clay E. Tully for descriptions of conventional electromechanical locking mechanisms.

It has been observed that there are problems that can affect the operation of many conventional motorized cylindrical locksets in the field over long periods of time. In part, this is because the electromechanical locking mechanisms included in such conventional locksets are very sensitive to variations in the on/off timing of the motor. Also, there is always the problem of motor stalling caused by overdriving the conventional electromechanical linkage should it encounter an unexpected obstruction and become bound up or jammed as it tries to move within the lockset between a door-unlocking position and door-locking position. For example, these conventional linkages can often become jammed if excessive torque is applied to the outside doorknob or handle manually by someone holding the outside knob or handle before and/or during the locking of the lockset using the electromechanical locking mechanism.

A motorized lock actuator able to move a locking lug or the like in a cylindrical lockset to lock or unlock a door handle without stalling or damaging the miniature lock actuator motor or impairing operation of the lockset would be a welcomed improvement over conventional motorized lock actuators. Moreover, cylindrical locksets could be improved by providing a motorized lock actuator having a compact size and simple construction and a configuration designed to fit inside conventional cylindrical locksets. Such a design would make it possible for current owners of many conventional fully mechanical cylindrical locksets to retrofit such locksets with new motorized lock actuators in accordance with the present invention without a lot of trouble or expense.

According to the present invention, an improvement is provided for use in actuating a locking means in a cylindrical lockset. The improvement includes means for moving the locking means between door handle locking and unlocking positions. The moving means includes a plunger having an axis, a locking-assist spring coupled to the plunger and the locking means, and means for reciprocating the plunger along its axis in opposite directions. To lock the cylindrical lockset, the reciprocating means moves the plunger along its axis in a locking direction against the locking-assist spring so that the locking-assist spring is moved toward the locking means to urge the locking means to its door handle-locking position. To unlock the cylindrical lockset, the reciprocating means moves the plunger along its axis in an opposite, unlocking direction away from the locking means so that the locking means is allowed to move to assume its door handle-unlocking position.

In preferred embodiments, the locking means includes a bushing and a locking lug coupled to the bushing. The bushing is able to reciprocate along the axis of the plunger and carry the locking lug between a handle-locking position wherein the locking lug locks a rotatable door handle to a fixed hub mounted in the door and a handle-unlocking position wherein the locking lug disengages the door-mounted hub to allow a user to rotate the handle relative to the door-mounted hub so that a latch bolt mounted in the door is retracted and the door can be opened.

Illustratively, the reciprocating means includes a rotatable spindle having a threaded distal end and a miniature motor for rotating the spindle about its axis. The plunger is an elongated rod having one end formed to include a blind threaded hole receiving the threaded distal end of the spindle. The opposite end of the plunger is arranged to extend into a central aperture formed in the reciprocable bushing. The locking-assist spring is a coiled compression spring winding around the plunger and having a first end abutting an external shoulder formed on the plunger and a second end abutting the reciprocable bushing.

In use, the motor is used to rotate the spindle which causes the plunger to advance in its locking direction due to the threaded connection between the spindle and the plunger. One unique aspect of the invention is that the plunger pushes the locking-assist spring to move the bushing and the locking lug mounted on the bushing far enough along the axis of the plunger so that the locking lug reaches its door-locking position. Ordinarily, the locking-assist spring will behave as a fairly stiff member and move the bushing in the locking direction in response to movement of the plunger in the same direction. However, the locking-assist spring is designed to be compressed between the plunger and the bushing whenever an obstruction blocks movement of the bushing in the locking direction and the motor continues to move the plunger against the spring and into the central aperture formed in the bushing. This compression causes a predetermined amount of potential energy to be stored in the locking-assist spring. Upon removal of the obstruction, the locking-assist spring is designed to decompress and move the now freely movable bushing and its locking lug to the handle-locking position.

Advantageously, obstruction of the bushing during locking or unlocking of the lockset is not expected to hinder movement of the plunger or impair operation of the motor or lockset. The motor always drives the plunger to a fully extended position in either the locking or unlocking direction every time the motor is actuated. This is possible because the plunger is coupled to the bushing by a compressible spring. Therefore, stalling of and damage to the motor and impairment of the operation of the lockset is minimized because of the novel way in which the motor is coupled to drive the bushing and the locking lug to its handle-locking position.

It will be understood that the so-called locking-assist spring functions to provide spring means for yieldably biasing the locking means (e.g., bushing and locking lug) toward its door handle-locking position. Preferably, another spring is included in the means for moving the locking means between door handle-locking and door handle-unlocking positions to provide spring means for yieldably biasing the locking means toward its door handle-unlocking position. This other spring is preferably a coiled compression spring that is located between the bushing and the door handle and functions to assist in moving the bushing in the unlocking direction. In use, if movement of the bushing in the unlocking direction is obstructed, the motor can still complete its cycle and move the spindle and plunger away from the obstructed bushing without stalling or damaging the motor or impairing the operation of the lockset. Later, upon removal of the obstruction, the unlocking-assist spring will decompress and move the bushing and its locking lug to the door handle-unlocking position to complete the unlocking of the cylindrical lockset.

The motor, rotating spindle, reciprocating plunger, and locking-assist spring in accordance with the present invention are easily mounted in certain conventional cylindrical locksets to permit such a lockset to be converted from a fully mechanical lock actuator to a motorized lock actuator in the field or in the shop. Most importantly, any obstruction of the locking lug as it moves in the cylindrical lockset between its door handle-locking and -unlocking position does not disrupt operation of the motor, rotation of the spindle, movement of the plunger, or operation of the locking-assist spring. This lengthens the life of the motor and minimizes disfunction of the motorized lock actuator.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
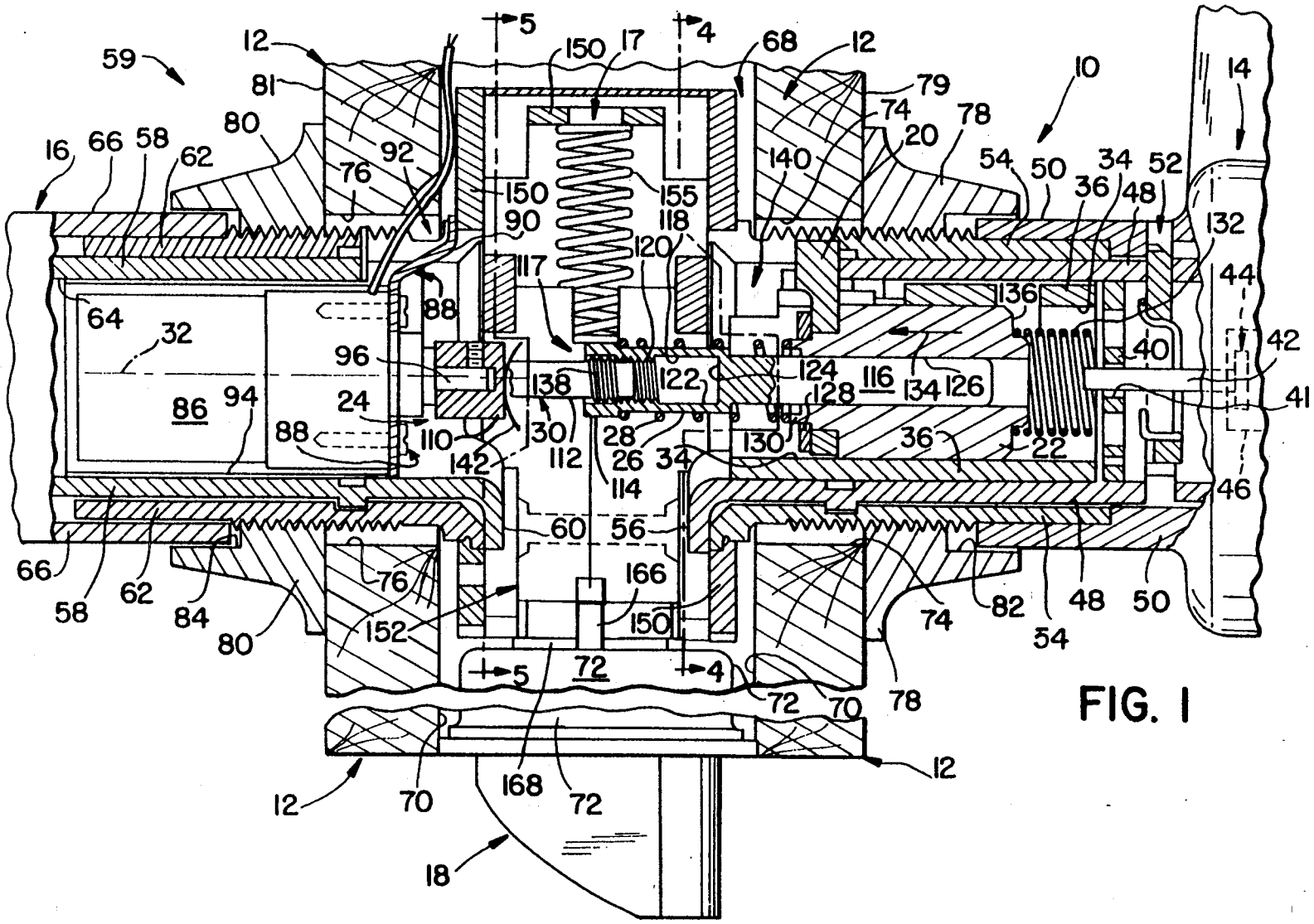
FIG. 1 is a longitudinal section through a cylindrical lockset embodying the invention, taken in a horizontal plane, on the line 1—1 of FIG. 5 and showing a spring-biased latch bolt, a motor-controlled lock actuator, and a locking lug arranged to lie in a door handle-locking position engaging both a fixed hub and a rotatable knob sleeve, and wherein the locking lug is carried on a reciprocable bushing and is actuated by the motor-controlled lock actuator.
Figure 2:
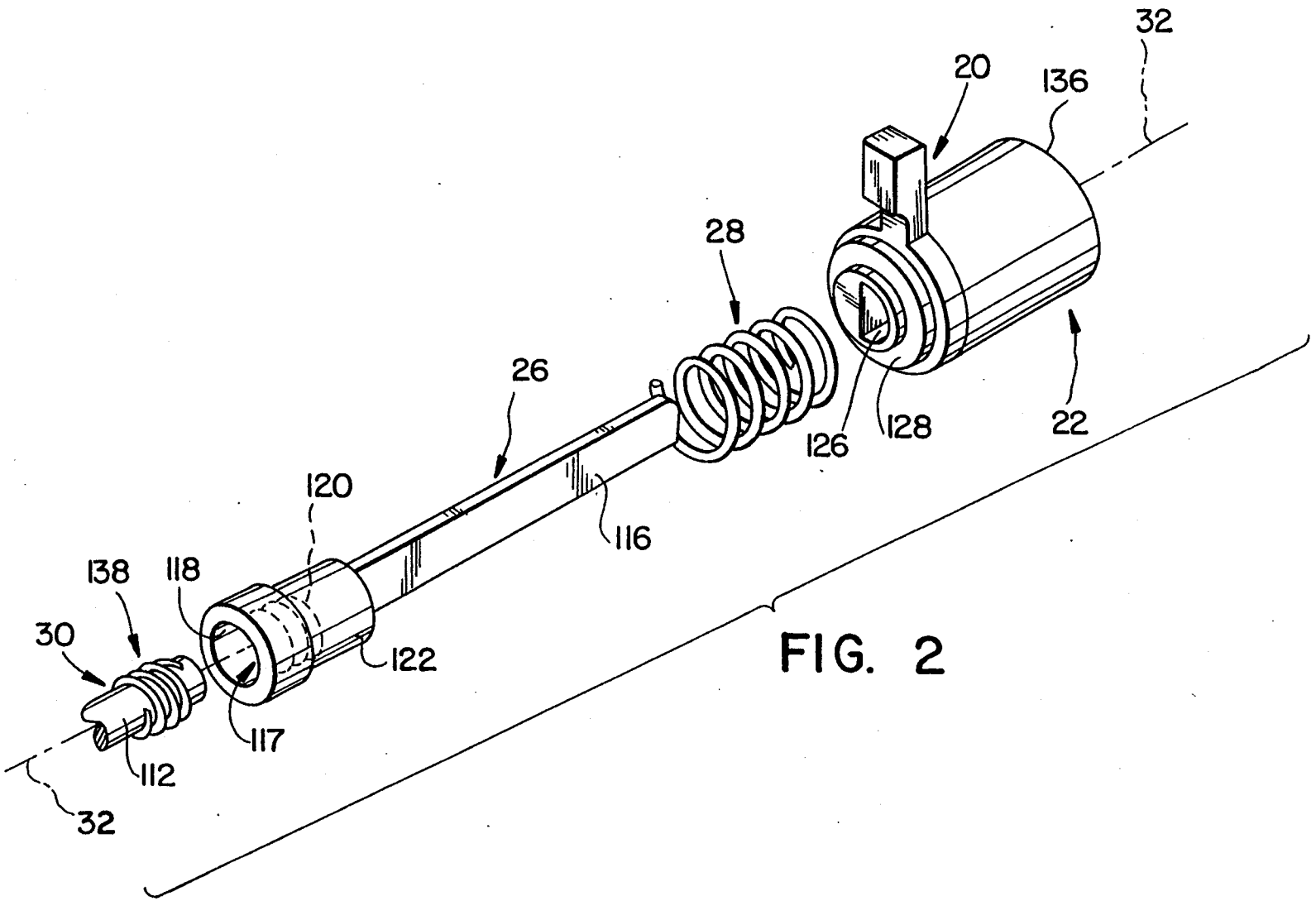
FIG. 2 is an exploded assembly view of the motor-controlled lock actuator shown in FIG. 1 showing a rotatable spindle, plunger, locking-assist spring, reciprocating bushing, and locking lug on the bushing.

A cylindrical lockset 10 is mounted in a door 12 and operable by means of either an outside door handle 14 or an inside door handle 16 to retract a retractor assembly 17 including spring-biased latch bolt 18 as shown in FIG. 1. The lockset 10 includes a locking lug 20 mounted on a reciprocable locking lug bushing 22 and an improved motor-controlled lock actuator 24 for moving the reciprocable bushing 22 and locking lug 20 between an outside door handle-locking position shown in FIG. 1 and an outside door handle-unlocking position shown in FIG. 3. As show in FIGS. 1 and 2, the improved motor-controlled lock actuator 24 includes a plunger 26, a locking-assist spring 28 coupled to the plunger 26 and the bushing 22, and a rotatable motor shaft spindle 30 for reciprocating the plunger 26 along central axis 32 to cause the reciprocable bushing 22 and locking lug 20 to move back and forth between its locking and unlocking positions.

Figure 4:
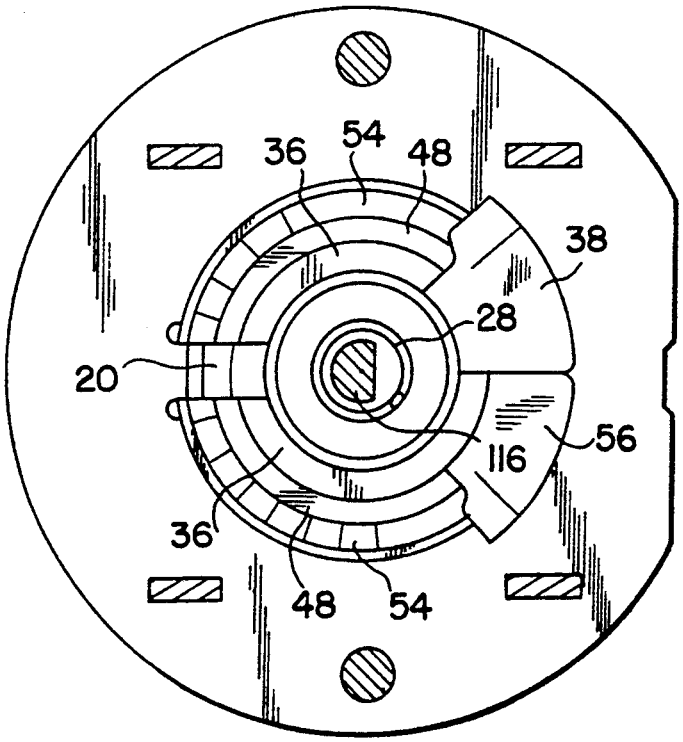
FIG. 4 is a transverse section on the line 4—4 of FIG. 1 showing the locking lug in its door handle-locking position in a slot on the left and, on the right, a door handle-actuated roll-back cam and a key-actuated roll-back cam above the door handle-actuated roll-back cam.

As shown in FIG. 1, locking lug bushing 22 is mounted for back and forth sliding movement in a central passageway 34 formed in a key-actuated roll-back sleeve 36. This cylindrical sleeve 36 includes a conventional pie-shaped, radially outwardly projecting, roll-back cam 38 at its inner end as shown in FIG. 4 and an end wall 40 at its outer end that is formed to include a transverse slot 41 which receives the flat end 42 of a conventional throw member 44 as shown in FIG. 1. It will be understood that an operating key (not shown) inserted into a lock core 46 mounted in outside door handle 14 can be rotated to rotate the flat end 42 of throw member 44 and thereby rotate the cylindrical key-actuated roll-back sleeve 36 about central axis 32. Rotation of the key-actuated roll-back sleeve 36 will cause its roll-back cam 38 to roll back the retractor assembly 17 shown in FIG. 1 to retract the spring-biased latch bolt 18 into the door 12.

As is the custom, the key-actuated roll-back sleeve 36 is mounted for rotation inside a somewhat larger diameter, cylindrical handle sleeve 48 as shown in FIG. 1. The outside door handle 14 includes a cylindrical neck 50 mounted around the outer end of the handle sleeve 48 and held in place by a conventional radially outwardly projecting spring-loaded handle keeper 52. Further, the handle sleeve 48 is mounted for rotation inside a cylindrical fixed hub 54. As also shown in FIG. 1, another pie-shaped, radially outwardly projecting roll-back cam 56 is formed on the inner end of handle sleeve 48. This roll-back cam 56 is also shown in FIG. 4 and normally lies next to the roll-back cam 38 on the key-actuated roll-back sleeve 36. It will be understood that a user can rotate the outside door handle 14 to rotate the cylindrical handle sleeve 48 inside fixed hub 54 about central axis 32. Rotation of the handle sleeve 48 will cause its roll-back cam 56 to roll back the retractor assembly 17 shown in FIG. 1 to retract the spring-biased latch bolt 18 into the door 12. Thus, latch bolt 18 can be rolled back either by turning a key (not shown) to rotate the key-actuated roll-back sleeve 36 or by turning the outside door handle 14 to rotate the handle sleeve 48.

Figure 5:
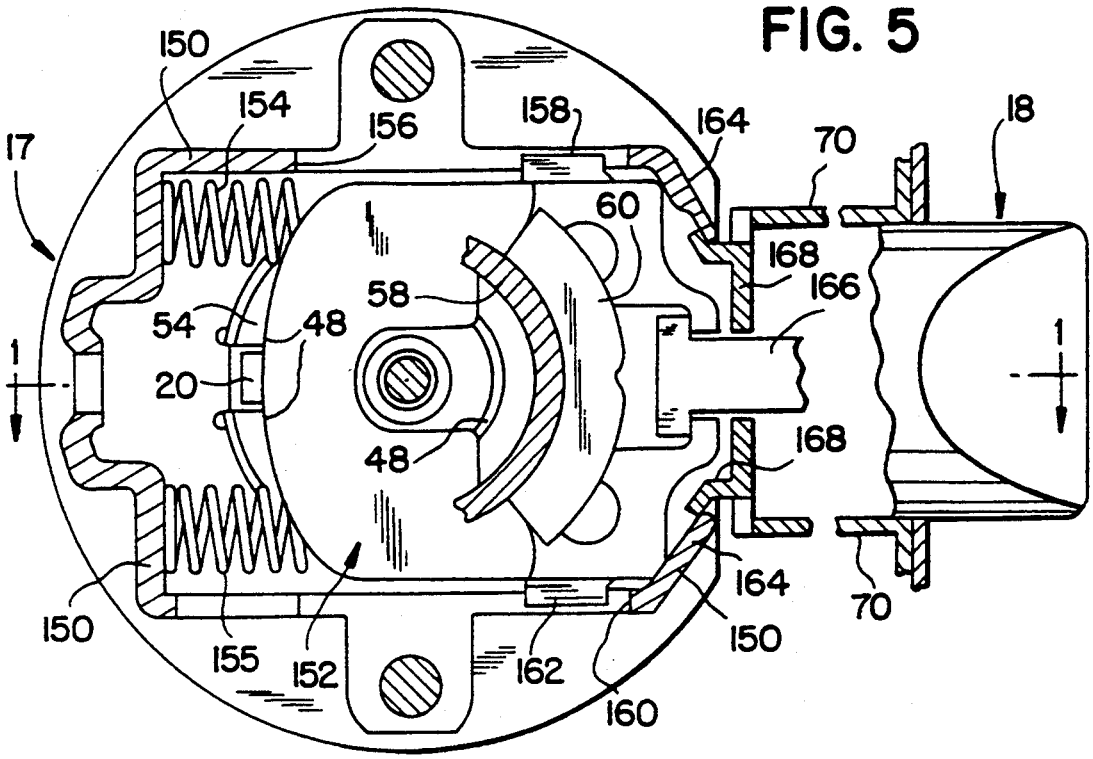
FIG. 5 is a transverse section on the line 5—5 of FIG. 1 showing a latch bolt and a spring-biased latch bolt retractor assembly for retracting a tailpiece connected to the latch bolt.

As shown in FIG. 1, another cylindrical handle sleeve 58 is provided on the inside handle side 59 of the cylindrical lockset 10 and formed to include its own arcuate, radially outwardly projecting roll-back cam 60 that is coupled to the retractor assembly 17. This arcuate roll-back cam 60 is also shown in FIG. 5. The inside handle sleeve 58 is mounted for rotation inside another cylindrical fixed hub 62 and is formed to include an elongated motor-receiving central passageway 64. The inside handle 16 includes a cylindrical neck 66 that is mounted around inside handle sleeve 58 and fixed hub 62 and held in place in the usual way so that rotation of the inside handle 16 by a user will cause inside handle sleeve 58 and its roll-back cam 60 to roll back the retractor assembly 17 shown in FIG. 1 to retract the spring-biased latch bolt 18.

As shown in FIG. 1, the door 12 is prepared in the customary way to include a central cavity 68 containing the latch retractor assembly 17, an end bore 70 receiving a latch tube 72 containing the spring-biased latch bolt 18, a first side bore 74 receiving the outside fixed hub 54, and a second side bore 76 receiving the inside fixed hub 62. An outside rose ring 78 is mounted on exterior surface 79 of door 12 and threaded to receive outside fixed hub 54 and hold it in place in the first side bore 74. Also, an inside rose ring 80 is mounted on an interior surface 81 of door 12 and threaded to receive inside fixed hub 62 and hold it in place in the second side bore 76. Each rose ring 78, 80 is formed to include a handle neck-receiving annular channel 82, 84, respectively, as shown in FIG. 1.

The motor-controlled lock actuator 24 also includes a miniature DC motor 86 positioned in the motor-receiving central passageway 64 formed in inside handle sleeve 58 and secured in place by a stamped metal motor clamp plate 88 having an anchor portion 90 engaging a slot 92 formed in the inside fixed hub 62. The motor clamp plate 88 anchors the motor 86 to the inside fixed hub 62 so that it will not rotate in inside handle sleeve 58 about central axis 32 during operation. Motor clamp plate 88 is also trapped between motor sleeve 94 and retractor frame 150 to limit movement of clamp plate 88 along axis 32 as shown in FIG. 1. Illustratively, motor 86 is encased in a deep draw metal stamping or plastic thin-walled cylindrical motor sleeve 94. Motor sleeve 94 is a housing which functions both as a support against other elements in the lockset 10 and a protective covering for the motor's electrical wires. Motor 86 also includes a drive shaft 96 which can be rotated in either a clockwise or counterclockwise direction about central axis 32.

Motor shaft spindle 30 includes a socket 110 and a cylindrical post 112. Socket 110 is configured to mate and turn with the outer end of motor drive shaft 96. Illustratively, a setscrew is used to anchor socket 110 on motor drive shaft 96. Post 112 has one end appended to socket 110 and another end formed to include a plurality of external threads 138. Motor shaft spindle 30 functions to convert rotational movement of the motor drive shaft 96 into reciprocating axial movement of plunger 26 along central axis 32 so that motor 86 can be used to move the locking lug 20 on bushing 22 back and forth between the outside door handle-locking position shown in FIG. 1 and the outside door handle-unlocking position shown in FIG. 3.

Plunger 26 includes a connector portion 114 at one end and a slider portion 116 at the other end. Connector portion 114 is formed to include a blind hole 117 that is sized to receive the threaded end 138 of post 112. The interior side wall 118 defining blind hole 117 includes a plurality of internal threads designed to mate with the external threads 138 formed on post 112. Threads in blind hole 117 define a threaded section 120 situated in an axially outer portion of interior side wall 118 near the open mouth of blind hole 117. As shown in FIG. 1, the interior side wall 118 also includes an unthreaded section 122 located deeper in the blind hole 117 between threaded section 120 and a bottom wall 124 of the blind hole 117. This unthreaded section 122 operates to receive the threaded end 138 of post 112 during a certain stage of operation to allow motor shaft spindle 30 to rotate inside blind hole 117 about central axis 32 without converting rotation of the motor shaft spindle 30 into axial movement of the plunger 26 along central axis 32. This function will be explained in greater detail below.

Motor shaft spindle 30 and plunger 26 can be made out of a variety of materials including brass, steel, and zinc. Plunger 26 could also be made out of plastics material including a threaded insert made out of the same material as motor shaft spindle 30 and configured to define the threaded section 120 inside blind hole 117 of plunger 26. The parts 26, 30 can also be made using powdered metal processes.

Locking lug bushing 22 is formed to include a longitudinally extending aperture 126 sized to receive the slider portion 116 of plunger 26. Slider portion 116 includes a spline that mates with aperture 126 to prevent rotation of slider portion 116 in aperture 126 about central axis 32 as plunger 26 reciprocates along central axis 32 during operation of the motor-controlled lock actuator 24. An annular flange 128 is mounted on the inner end of bushing 22 to hold locking lug 40 in place. An annular spring mount 130 projects through a central aperture formed in annular flange 128 as shown in FIG. 1.

Figure 3:
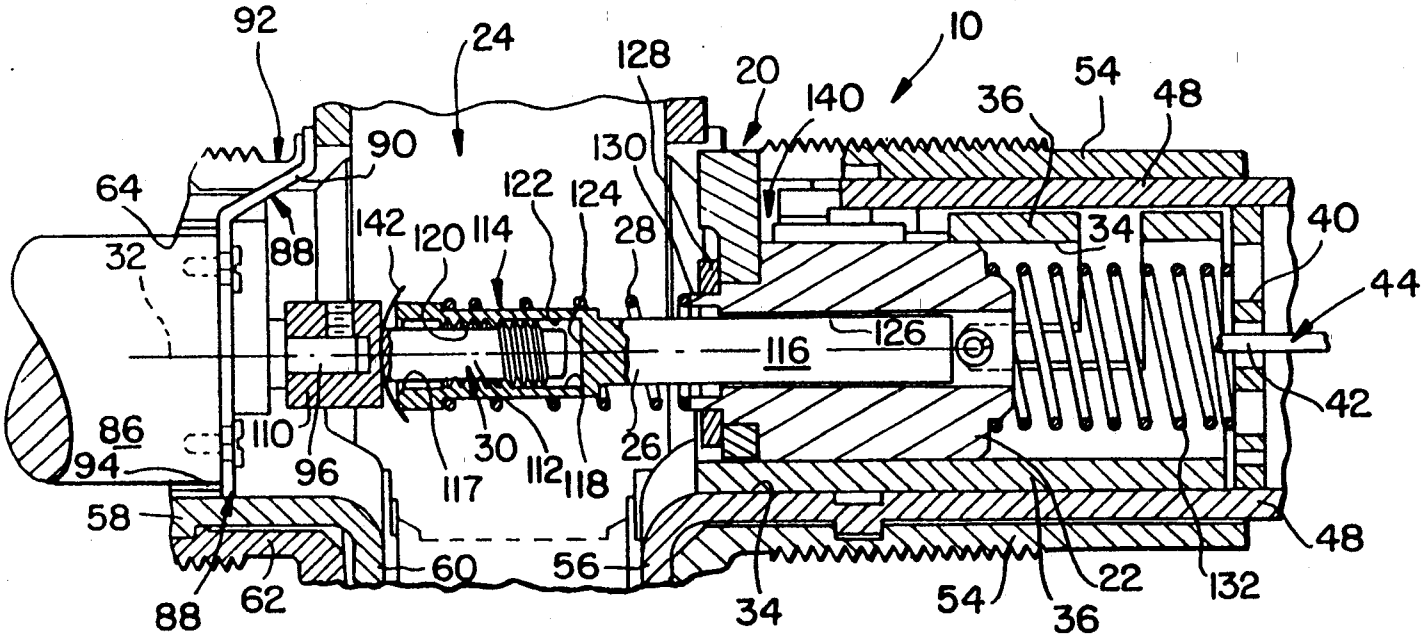
FIG. 3 is a view similar to FIG. 1, with the latch bolt retractor omitted, showing the locking lug in its door handle-unlocking position.

Locking-assist spring 28 is a coiled compression spring that functions to transfer force from the plunger 26 to the bushing 22 so that the bushing 22 slides in the passageway 34 formed in the key-actuated roll-back sleeve to move the locking lug 20 from its outside door handle-unlocking position shown in FIG. 3 to its outside door handle-locking position shown in FIG. 1 in response to axial movement of plunger 26 along central axis 32 toward the outside door handle 14. Locking-assist spring 28 includes a first end abutting an external shoulder formed on the connector portion 114 of plunger 26 and a second end abutting the annular spring mount 130 formed on the locking lug bushing 22. Illustratively, the locking-assist spring 28 is an elongated coiled spring that winds around the exterior surface of plunger 26 as shown in FIG. 1.

An unlocking-assist spring 132 is also provided to urge locking lug bushing 22 in direction 134 toward the retractor assembly 17 when it is time to move the locking lug 20 from its outside door handle-locking position shown in FIG. 1 to its outside door handle-unlocking position shown in FIG. 3. Unlocking-assist spring 132 is a coiled compression spring having a first end abutting an outer end 136 of bushing 22 and a second end abutting an inner surface on end wall 40 of key-actuated roll-back sleeve 36.

Many of the components in retractor assembly 17 are shown in FIGS. 1 and 5. As shown in FIG. 5, retractor assembly 17 includes a retractor frame 150, a retractor 152 mounted for movement inside retractor frame 150, and top and bottom retractor springs 154, 155 for yieldably urging the retractor 152 to the latch-projecting position shown in FIGS. 1 and 5. The retractor frame 150 includes a top slot 156 for receiving top retractor guide 158 and a bottom slot 160 for receiving bottom retractor guide 162. The retractor 152 includes prongs 164 for gripping and pulling tailpiece 166 during operation of retractor assembly 17 to retract latch bolt 18 into door 12. The tailpiece 166 is connected to the latch bolt 18 in the conventional way and extends through a slot formed in a back plate 168 that is mounted on the retractor frame to lie between the retractor 152 and the inner end of the latch tube 70. Retractor 152 includes conventional cam followers which are engaged by roll-back cams 38, 56, and 60 to enable a user to roll back retractor 152 against the bias provided by top and bottom retractor springs 154, 155, and thereby pull tailpiece 166 to retract latch bolt 18 into door 12.

In use, as the motor shaft spindle 30 is rotated by motor 86, the external threads 138 on cylindrical post 112 of spindle 30 move in the blind hole 117 formed in plunger 26 to engage and disengage the threads in threaded section 120. Illustratively, the spindle 30 includes approximately four threads 138, as shown best in FIG. 2, with clearance machined behind the threads 138 to allow rotation of the spindle 30 without additional linear movement along central axis 32 of the plunger 26. Plunger 26 moves linearly along central axis 32 as the threaded portion 138 of spindle 30 engages the threaded section 120 and rotates inside the blind hole 117 formed in the connector portion 114 of plunger 26. The blind hole 117 is formed to include only the necessary number of threads in threaded section 120 to yield the required linear movement of plunger 26 along central axis 32. Thus, during operation of the motor 86 to rotate drive shaft 96, the spindle 30 rotates about central axis 32 to advance the plunger 26 in a selected direction along central axis 32.

In the illustrated embodiment, to lock the outside handle 14 against rotation, plunger 26 is moved along central axis 32 away from motor 86 to push locking-assist spring 28 against bushing 22 and thereby move bushing 22 about 0.250 inch (0.63 cm) to carry the locking lug 20 mounted on bushing 22 to its outside door handle-locking position shown in FIG. 1. This movement of bushing 22 acts to compress the unlocking-assist spring 132 against end wall 40 in the manner shown in FIG. 1.

The outside door handle 14 is unlocked automatically in the following manner. When a user causes the motor 86 to reverse the direction of rotation of drive shaft 96, spindle 30 rotates to pull plunger 26 in direction 134 toward the motor 86 (by virtue of the threaded connection between spindle 30 and plunger 26) to move bushing 22 in the passageway 134 formed in key-actuated roll-back sleeve 36 to the position shown in FIG. 3. The unlocking-assist spring 132 expands at the same time to help move bushing 22 to the position shown in FIG. 3. Such movement of bushing 22 functions to move the locking lug 20 in a slot 140 (FIGS. 1 and 3) where it no longer acts to block rotational movement of outside handle sleeve 48 relative to the surrounding cylindrical fixed hub 54. In the locked position, locking lug 20 engages both the outside handle sleeve 48 and the outside fixed hub 54 as shown in FIG. 1 to block rotation of sleeve 48 in hub 54. However, in the unlocked position, locking lug 20 has been moved in slot 140 to disengage outside handle sleeve 48 to permit rotation of sleeve 48 in hub 54. Accordingly, by using motor-controlled lock actuator 24, a user can automatically move locking lug 20 in slot 140 to unlock the outside door handle 14, thereby allowing the user to turn the outside door handle 14 to rotate the handle sleeve 48 causing its roll-back cam 56 to roll back the retractor assembly 17 to retract the spring-biased latch bolt 18 into the end bore 70 formed in door 12.

A wavey washer 142 or similar spring member is provided to ensure that threads 138 on spindle 30 always engage the threads 120 on plunger 26 at the proper time (i.e., when the locking lug 20 is in the unlocked position). As shown in FIG. 3, the wavey washer 142 is mounted on post 112 to act against socket 110 and connector portion 114 when the locking lug 20 is arranged to lie in its outside door handle-unlocking position.

Spindle 30 and plunger 26 are designed in such a way that spindle 30 becomes self-disengaged from plunger 26 after causing the desired linear movement of plunger 26 in either direction. Both spindle 30 and plunger 26 have only the number of threads necessary for the required linear movement. Advantageously, this allows actuator 24 to be less sensitive to variations in the on/off timing of motor 86 and eliminates the possibility of the motor stalling due to overdriving the bushing and locking lug subassembly 22, 20 in either the locked or unlocked position.

Figure 9:
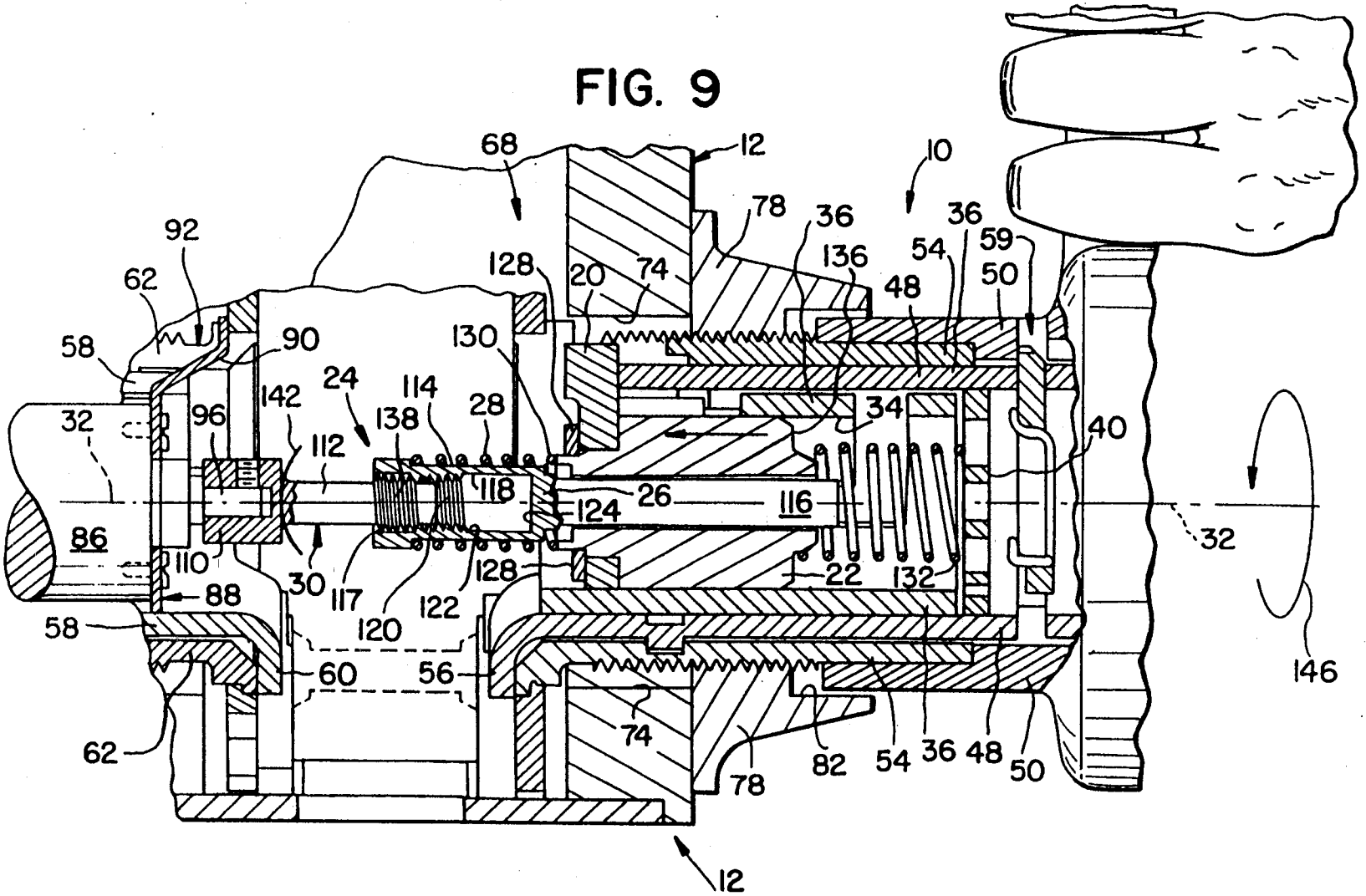
FIG. 9 is a view similar to FIG. 1, with the latch bolt retractor omitted, showing compression of the locking-assist spring between the plunger and the bushing as a result of an obstruction blocking further movement of the locking lug from its door handle-unlocking position toward its door handle-locking position so that sufficient potential energy is stored in the locking-assist spring to enable it to move the bushing and locking lug to its door handle-locking position upon removal of the locking lug obstruction.

Plunger 26 is not directly secured to bushing 22 (which carries locking lug 20). However, the linear movement of plunger 26 (to lock outside door handle 14) is transferred to bushing 22 by locking-assist spring 28 which surrounds the plunger 26 and is trapped between an external shoulder on plunger 26 and the inner face of bushing 22. During a locking cycle, by transferring the movement of plunger 26 to locking lug bushing 22 via locking-assist spring 28, the motor 86 is allowed to complete its preprogrammed number of revolutions, even though the locking lug 20 may become bound in position as shown in FIG. 9. For example, as shown in FIG. 9, a user may inadvertently or purposefully apply enough torque 146 manually to the outside door handle 14 to cause such binding during operation of motor 86 to complete a locking cycle. Advantageously, if the locking lug 20 becomes bound during the locking cycle, the motor 86 operates to complete its cycle and potential energy is stored in the locking-assist spring 28 to enable the locking-assist spring 28 to complete the locking action once the locking lug 20 becomes unbound. Again, this binding problem occurs if excessive torque is placed on the outside door handle or knob 14 before and/or during the locking of the lockset 10.

Figures 6, 7:
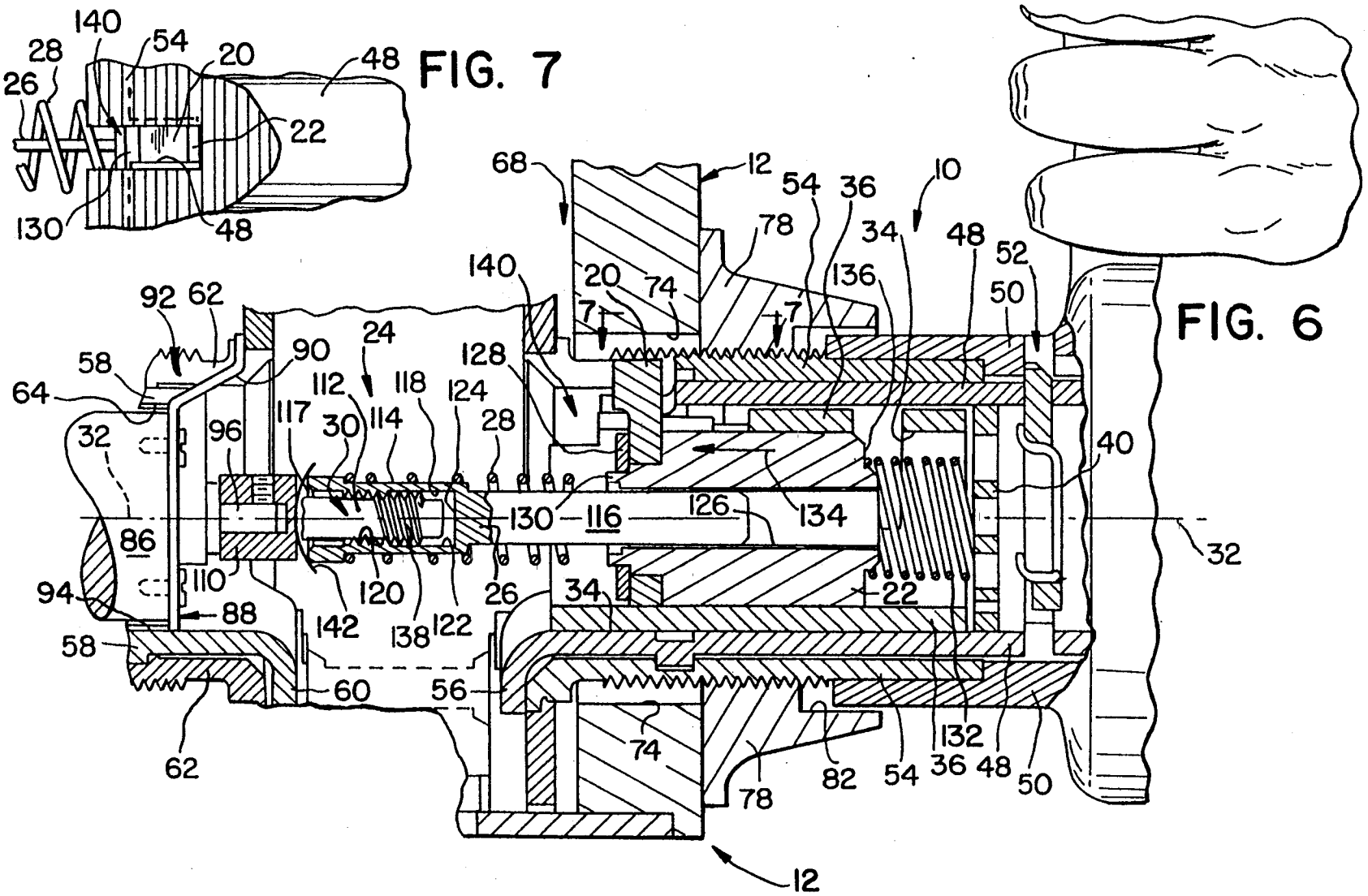
FIG. 6 is a view similar to FIGS. 1 and 3, with the latch bolt retractor omitted, showing an obstructed locking lug bound up midway from its door handle-locking position toward its door handle-unlocking position by application of torque to the outside door handle and compression of the unlocking-assist spring.
FIG. 7 is a top view of the obstructed locking lug and portions of the motor-controlled lock actuator on the line 7—7 of FIG. 6.
Figure 8:
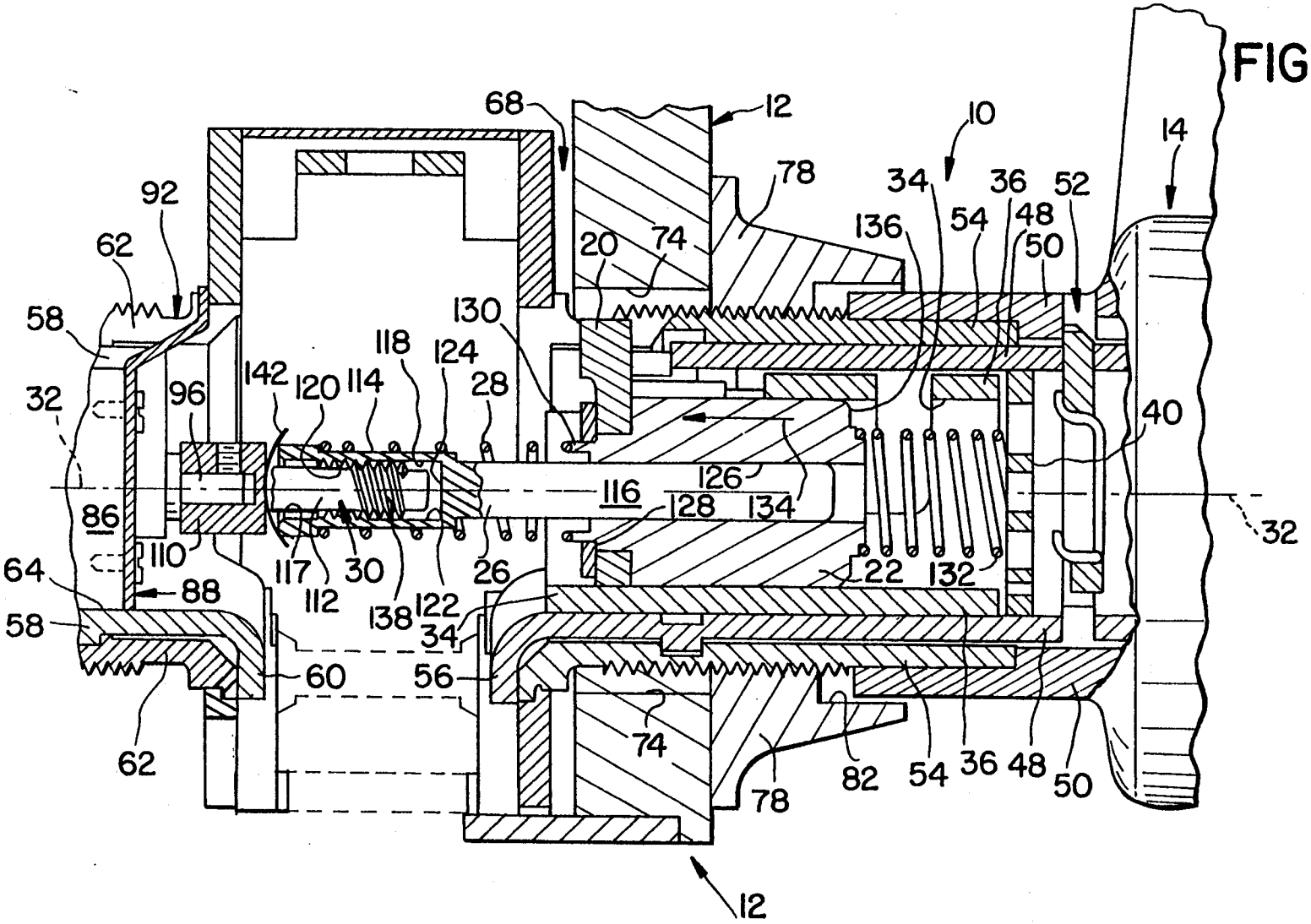
FIG. 8 is a view similar to FIG. 6 showing decompression of the unlocking-assist spring to move the bushing and locking lug to the door handle-unlocking position upon removal of a locking lug obstruction of the type shown in FIG. 6.

If a similar binding problem occurs during unlocking, as shown in FIGS. 6 and 7, the unlocking-assist spring 132 located behind locking lug bushing 22 expands to help complete unlocking of the lockset 10 as shown in FIG. 8. Once the locking lug 20 is no longer bound up, and after motor 86 has completed its unlocking cycle, the potential energy stored in unlocking-assist spring 132 is released to move the locking lug bushing 22 in direction 134 as shown in FIG. 8 and thereby move the locking lug 20 in slot 140 to assume its outside door handle-unlocking position.

As shown in FIG. 8, it is possible that the right end of locking-assist spring 28 may be pulled away from engagement with the annular spring mount 130 on bushing 22. Of course, engagement of the locking-assist spring 28 and the annular spring mount 130 will be reestablished once the motor 86 is actuated to begin the next locking cycle. As also shown in FIG. 8, the wavey washer 142 loads the threads 138 on post 112 against the threaded section 120 in blind hole 117 so that the motor shaft spindle 30 will threadedly engage the plunger 26 once the motor 86 is actuated to begin the next locking cycle.

Advantageously, cylindrical lockset 10 is an electronic, battery-powered, stand-alone lockset. Motor 86 is selected to consume as little power as possible. Preferably, a miniature DC motor is used of the type that can be run by a low-voltage DC battery power. Such a motor consumes relatively low power as compared to a conventional electric solenoid. Power is conserved also by allowing spindle 30 and plunger 26 to self-disengage after completion of linear movement of plunger 26. Since full linear movement is required for adequate lock operation, the motor 86 is programmed to continue to run until shortly after the movement is complete. Without disengagement, this could result in overtravel by the locking lug 20 and in the locked position could bottom out the locking lug 20 in the slot. If the locking lug 20 bottoms, the motor 86 consumes more power as it works harder and stalls.

Power is also conserved by not having the plunger 26 coupled directly to the bushing 22 and instead by transferring movement of plunger 26 to bushing 22 via a spring. If the locking lug 20 is bound, in either unlocked or locked position or at any time during either a locking or unlocking cycle, the motor 86 completes its cycle and the energy stored in one of the springs is used to complete the action once the locking lug 20 becomes unbound. Again, the motor 86 is able to spin freely, thereby conserving power and preserving battery life.

Because the number of components needed to electrify the lockset 10 is small, and the lockset 10 does not undergo major modification, it is possible for certain existing mechanical locksets to be retrofitted to an electrified lockset chassis using the motor-controlled lock actuator 24 of the present invention. The motor 86 and protective sleeve 94 fit snugly into the existing hub 62 and the wires exit out an existing slot. A new bushing 22 is required, the bushing having an inside spline 126 (presently "D" or "double D" in shape) to mate with the outside spline 116 of the plunger 26. The plunger 26 and the spindle 30 fit between the existing retractor halves of the retractor assembly 17 requiring no change or modification to the retractor assembly 17. The inside handle sleeve is replaced with a modified sleeve 58 that was developed to clear wires exiting the hub 62. The above retrofit can be easily accomplished in the field, requiring no change or modification to the retractor assembly and requiring little time and no special tools.

The spindle 30 becomes self-disengaged from the plunger 26 once the desired linear movement is complete. The motor 86 can never be stalled due to overdrive of the mechanism in either direction and allows for greater variation in the on/off time in the cycle. Even a slight overdrive of the locking lug 20, causing it to bottom in the slot, would cause the motor 86 to work harder, increasing power consumption, and greatly reducing battery life. Also, if a malfunction in the control were to leave the motor 86 on, the motor 86 would not stall and would possibly "burn up." This saves the owner from having to replace the motor 86 due to this malfunction.

An additional advantage of the disengagement feature of the mechanism 24 is that it is not sensitive to a particular "rpm" (revolutions per minute) of the motor 86. As batteries drain due to age and usage, their voltage decreases which causes a proportional decrease in the rpm of the motor. To program the on/off time for the improved motor-controlled lock actuator 24, only the longest "on" time for the motor 86 at the lowest functional voltage need be considered. This longest "on" time would ensure that the spindle 30 has revolved a sufficient number of times to yield the required linear movement of the plunger 26 for locking and unlocking the lockset 10. The motor 86 can then be operated at higher voltages, as when the batteries are new, without concern of overdriving the locking lug 20. The use of screw threads to obtain the desired linear movement is also an improvement. The threads not only allow disengagement as discussed above but are also a more positive drive to actuate the mechanism.

Although the invention has been described in detail with reference to certain preferred embodiments, variations, and modifications exist within the scope and spirit of the invention as described and defined in the following claims.

We claim:

1. In a cylindrical lock of the type including a chassis having a hub and means for mounting the hub in a fixed position on a door, a handle sleeve mounted for rotation relative to the hub, the handle sleeve having means for supporting a door handle and latch-retracting means for retracting a movable latch coupled to the chassis, and means for locking the handle sleeve against rotation relative to the hub, the locking means being movable along the axis of rotation of the handle sleeve between a sleeve-locking position and a sleeve-unlocking position, the improvement comprising means for moving the locking means between its sleeve-locking and unlocking positions, the moving means including a plunger having an axis, a locking-assist spring coupled to the plunger and the locking means, and means for reciprocating the plunger along its axis in one of a locking direction against the locking-assist spring so that the locking-assist spring is moved toward the locking means to urge the locking means to its sleeve-locking position and an opposite unlocking direction away from the locking means so that the locking means is allowed to move to assume its sleeve-unlocking position.

2. The improvement of claim 1, wherein the plunger is formed to include a blind hole and the reciprocating means includes a spindle having a distal end extending into the blind hole.

3. The improvement of claim 2, wherein the plunger includes a threaded section in the blind hole and the distal end of the spindle is threaded to rotatably engage the threaded section in the blind hole of the plunger and convert rotational movement of the spindle into movement of the plunger along its axis in the locking direction.

4. The improvement of claim 3, wherein the plunger includes an interior side wall and a bottom wall that cooperate to define the blind hole, the plunger is formed to include a mouth opening into the blind hole and lying a predetermined distance from the bottom wall, the threaded section is situated in an axially outer portion of the side wall near the mouth of the blind hole, and the side wall includes an unthreaded section between the threaded section and the bottom wall to provide means for allowing rotation of the threaded distal end of the spindle in the blind hole without causing further movement of the plunger in the locking direction along its axis relative to the locking means.

5. The improvement of claim 3, wherein the reciprocating means further includes means for rotating the spindle to cause the threaded distal end of the spindle to ride in the threaded section in the blind hole of the plunger so that rotational movement of the spindle is converted into limited movement of the plunger along its axis in the locking direction.

6. The improvement of claim 2, wherein the plunger includes a threaded section and an unthreaded section in the blind hole and the reciprocating means further includes means for rotating the spindle in the blind hole to cause the threaded distal end of the spindle to pass in sequence first through the threaded section and then through the unthreaded section in the blind hole so that rotational movement of the spindle is converted into movement of the plunger along its axis in the unlocking direction against the locking-assist spring to urge the locking means from its sleeve-locking position to its sleeve-unlocking position.

7. The improvement of claim 6, wherein the plunger includes an external shoulder, the locking means includes a bushing and a locking lug coupled to the bushing, the bushing is reciprocable along the axis of the plunger inside the handle sleeve to move the locking lug into and out of locking engagement with the hub and handle sleeve, and the locking-assist spring is a coiled compression spring surrounding the plunger and having a first end abutting the external shoulder and a second end abutting the bushing.

8. The improvement of claim 1, wherein the reciprocating means includes a spindle having a threaded distal end and the plunger includes means for threadedly engaging the threaded distal end of the spindle.

9. The improvement of claim 8, wherein the moving means further includes spring means for yieldably biasing the threaded distal end of the spindle into engagement with the engaging means whenever the locking means is in its sleeve-unlocking position.

10. The improvement of claim 9, wherein the spring means is a wavey washer mounted on the spindle.

11. The improvement of claim 8, wherein the threaded distal end of the spindle includes a set of external threads, the plunger is formed to include a blind hole, and the engaging means includes a set of internal threads configured to complement the set of external threads on the spindle and arranged to lie in the blind hole to engage the external threads on the spindle.

12. The improvement of claim 11, wherein the plunger includes an internal wall defining a bottom wall of the blind hole and an unthreaded side wall situated in the blind hole and arranged to lie between the internal threads and the bottom wall to provide a clearance region between the internal threads and the bottom wall to disengage a threaded connection between the internal and external threads and allow rotation of the spindle in the blind hole of the plunger without causing movement of the plunger along its axis in the locking direction.

13. The improvement of claim 8, wherein the reciprocating means further includes means for rotating the spindle to advance the plunger in the locking direction along its axis against the locking-assist spring so that the locking-assist spring effectively moves the locking means to its sleeve-locking position.

14. The improvement of claim 8, wherein the locking means includes a reciprocable bushing and a locking lug coupled to the bushing, the hub is formed to include a slot receiving the locking lug during reciprocating movement of the bushing relative to the hub, the locking lug is movable in the slot a predetermined axial distance between a first position disengaging the hub and the handle sleeve to allow relative movement between the hub and the handle sleeve to actuate the latch-retracting means and a second position engaging the hub and the handle sleeve to lock the handle sleeve to the hub, the engaging means includes means for converting rotational movement of the spindle into axial movement of the plunger in the locking direction a maximum distance equivalent to said predetermined axial distance so that axial movement of the plunger in the locking direction against the locking-assist spring causes the locking-assist spring only to move the locking lug from its first position to its second position without the possibility of locking lug overtravel past the second position.

15. In a cylindrical lock of the type including a chassis having a hub and means for mounting the hub in a fixed position on a door, a handle sleeve mounted for rotation relative to the hub, the handle sleeve having means for supporting a door handle and latch-retracting means for retracting a movable latch coupled to the chassis, and means for locking the handle sleeve against rotation relative to the hub, the locking means being movable along the axis of rotation of the handle sleeve between a sleeve-locking position and a sleeve-unlocking position, the improvement comprising means for moving the locking means between its sleeve-locking and unlocking positions, the moving means including a plunger having an axis, a locking-assist spring coupled to the plunger and the locking means, and means for reciprocating the plunger along its axis in one of a locking direction against the locking-assist spring so that the locking-assist spring is moved toward the locking means to urge the locking means to its sleeve-locking position and an opposite unlocking direction away from the locking means so that the locking means is allowed to move to assume its sleeve-unlocking position, the reciprocating means including a spindle, means for rotating the spindle about an axis of rotation, and means for linking the spindle and the plunger to convert continuous rotation of the spindle about its axis of rotation into limited movement of the plunger along its axis in the locking direction and against the locking-assist spring to compress the locking-assist spring between the plunger and the locking means whenever an obstruction blocks movement of the locking means to its sleeve-unlocking position so that a predetermined amount of potential energy is stored in the locking-assist spring owing to its compressed state to enable the locking-assist spring to decompress and move the locking means to its sleeve-locking position upon removal of said obstruction without further axial movement of the plunger along its axis in the locking direction and against the locking-assist spring.

16. The improvement of claim 15, wherein the plunger is formed to include a blind hole, the spindle includes a distal end extending into the blind hole, and the linking means includes a first threaded section on the distal end of the spindle and a complementary second threaded section on the plunger and in the blind hole.

17. The improvement of claim 16, wherein the plunger includes an interior side wall and a bottom wall that cooperate to define the blind hole, the plunger is formed to include a mouth opening into the blind hole and an unthreaded section, and the second threaded section is situated on the interior side wall in spaced relation to the bottom wall to position the unthreaded section in the blind hole between the second threaded section and the bottom wall.

18. The improvement of claim 15, wherein the plunger further includes an elongated trunk appended to the linking means and the locking means is formed to include means for supporting the elongated trunk for sliding movement along said axis of rotation during reciprocation of the plunger in the locking and unlocking directions.

19. The improvement of claim 18, wherein the locking means includes a bushing and a locking lug coupled to the bushing and the bushing is formed to include an aperture receiving the elongated trunk therein and defining the supporting means.

20. The improvement of claim 18, wherein the locking-assist spring surrounds at least a portion of the linking means and the elongated trunk.

21. The improvement of claim 15, wherein the locking-assist spring is a coiled compression spring having a first end abutting the plunger and a second end abutting the locking means.

22. The improvement of claim 21, wherein the locking means includes a bushing and a locking lug coupled to the bushing and the second end of the coiled compression spring abuts the bushing.

23. The improvement of claim 21, wherein the locking means includes a bushing and a locking lug coupled to the bushing, and the bushing is formed to include a central aperture slidably receiving one end of the plunger therein.

24. The improvement of claim 21, wherein the plunger includes an external shoulder abutting the first end of the coiled compression spring and the plunger is arranged to extend through a central passageway formed in the coiled compression spring.

25. The improvement of claim 15, wherein the rotating means includes a motor and a motor drive shaft and the spindle includes a distal end defining a first portion of the linking means and socket means for converting rotation of the motor drive shaft into rotation of the distal end of the spindle without imparting rotation to the locking-assist spring.

26. The improvement of claim 25, wherein the plunger includes a head defining a second portion of the linking means, the moving means further includes spring means for yieldably biasing the first portion of the linking means on the distal end of the spindle into engagement with the second portion of the linking means on the head of plunger whenever the locking means is in its sleeve-unlocking position, and the spring means is mounted on the spindle.

27. In a cylindrical lock of the type including a chassis having a hub and means for mounting the hub in a fixed position on a door, a handle sleeve mounted for rotation relative to the hub, the handle sleeve having means for supporting a door handle and latch-retracting means for retracting a movable latch coupled to the chassis, and means for locking the handle sleeve against rotation relative to the hub, the locking means being movable along the axis of rotation of the handle sleeve between a sleeve-locking position and a sleeve-unlocking position, the improvement comprising means for moving the locking means between its sleeve-locking and unlocking positions, the moving means including a rotatable spindle, a plunger having an axis, means for supporting the plunger for reciprocable movement along its axis, a locking-assist spring linking the plunger and the locking means, and means for coupling the spindle to the plunger to convert rotational movement of the spindle into axial movement of the plunger against the locking-assist spring so that the locking means is moved from its sleeve-locking position to its sleeve-unlocking position in response to a movement-inducing force applied to the locking means by the locking-assist spring.

28. The improvement of claim 27, wherein the coupling means includes a first threaded section on the rotatable spindle.

29. The improvement of claim 28, wherein the coupling means further includes a second threaded section situated on the plunger and configured to mate with the first threaded section.

30. The improvement of claim 29, wherein the plunger is formed to include a spindle-receiving aperture and the second threaded section is located in the spindle-receiving aperture.

31. The improvement of claim 29, wherein the moving means further includes spring means for yieldably biasing the first threaded section into engagement with the second threaded section whenever the locking means is in its sleeve-unlocking position.

32. The improvement of claim 27, wherein the locking-assist spring is a coiled compression spring having a first end abutting the plunger and a second end abutting the locking means and the plunger includes shoulder means for pushing against the first end of the coiled compression spring during movement of the plunger along its axis to move the coiled compression spring along said axis and generate the movement-inducing force that is applied to the locking means by the locking-assist spring.

33. The improvement of claim 32, wherein the coiled compression spring is configured to provide means for storing potential energy provided by the moving plunger by assuming a compressed configuration whenever movement of the locking means to its sleeve-unlocking position is obstructed and for releasing said potential energy by assuming an expanded configuration upon removal of said obstruction so that the locking means is moved to its sleeve-unlocking position by the coiled compression spring without further axial movement of the plunger along its axis and against the locking-assist spring.

34. The improvement of claim 27, wherein the moving means further includes a motor and a rotatable drive shaft and the rotatable spindle includes a distal end defining a first portion of the coupling means and socket means of converting rotation of the motor drive shaft into rotation of the distal end of the spindle without imparting any rotation to the locking-assist spring.

35. The improvement of claim 34, wherein the plunger includes a head defining a second portion of the coupling means, the moving means further includes spring means for yieldably biasing the first portion of the coupling means on the distal end of the spindle into engagement with the second portion of the coupling means on the head of plunger whenever the locking means is in its sleeve-unlocking position, and the spring means is mounted on the spindle.

36. In a cylindrical lock of the type including a chassis having a hub and means for mounting the hub in a fixed position on a door, a handle sleeve mounted for rotation relative to the hub, the handle sleeve having means for supporting a door handle and latch-retracting means for retracting a movable latch coupled to the chassis, and means for locking the handle sleeve against rotation relative to the hub, the locking means being movable along the axis of rotation of the handle sleeve between a sleeve-locking position and a sleeve-unlocking position, the improvement comprising means for moving the locking means between its sleeve-locking and unlocking positions, the moving means including first spring means for yieldably biasing the locking means toward its sleeve-unlocking position, a rotatable spindle, a plunger mounted for reciprocating movement in the chassis, second spring means for yieldably biasing the locking means toward its sleeve-locking position, the second spring means being positioned between the plunger and the locking means to convert movement of the plunger toward the latch handle into movement of the locking means toward its sleeve-locking position, and means for coupling the spindle to the plunger to convert rotational movement of the spindle into axial movement of the plunger against the second spring means so that the locking means is moved by the second spring means against the first spring means from its sleeve-unlocking position to its sleeve-locking position.

37. The cylindrical lock of claim 36, wherein the locking means includes a bushing and a locking lug coupled to the bushing.

38. The cylindrical lock of claim 37, wherein the bushing includes a first end engaging the first spring means and a second end engaging the second spring means.

39. The cylindrical lock of claim 37, further comprising a cylindrical sleeve having an end wall and wherein the bushing is situated for reciprocal movement within the cylindrical sleeve and the first spring means extends between the locking means and the end wall of the cylindrical sleeve.

40. A cylindrical lock comprising:

a latch bolt, a chassis configured to mount on a door, means for supporting a door handle for rotation about an axis relative to the chassis, the means for supporting the door handle having a drive connection to operate the latch bolt to open and close the lock, means for locking the supporting means to block rotation of the door handle relative to the chassis, a spring coupled to the locking means, and means for selectively pushing the spring toward the locking means in an axial direction to urge the locking means from a handle-unlocking position disengaging the supporting means to a handle-locking position lockably engaging the supporting means.

41. The cylindrical lock of claim 40, wherein the locking means includes a bushing and a locking lug coupled to the bushing and the spring is a coiled compression spring having a first end abutting the pushing means and a second end abutting the bushing.

42. The cylindrical lock of claim 41, wherein the bushing is formed to include a central aperture and the pushing means includes a plunger having an external shoulder abutting the first end of the coiled compression spring and an elongated trunk slidably received in the central aperture formed in the bushing.

43. The cylindrical lock of claim 42, wherein the pushing means further includes means for moving the plunger relative to the bushing to push the spring toward the locking means in said axial direction.

44. The cylindrical lock of claim 40, wherein the pushing means includes a rotating spindle, a sliding plunger engaging the spring, and means for linking the rotating spindle to the sliding plunger to convert rotation of the rotating spindle into limited movement of the sliding plunger in said axial direction so that the sliding plunger pushes the spring in said axial direction.

45. The cylindrical lock of claim 44, wherein the linking means includes a first threaded section on the rotating spindle and a second threaded section situated on the sliding plunger and configured to mate with the first threaded section.

46. The cylindrical lock of claim 45, wherein the plunger is formed to include a spindle-receiving aperture and the second threaded section is located in the spindle-receiving aperture.

47. The cylindrical lock of claim 45, wherein the plunger includes an interior side wall and a bottom wall that cooperate to define the spindle-receiving aperture, the plunger is formed to include a mouth opening into the spindle-receiving aperture and an unthreaded section, and the second threaded section is situated on the interior side wall in spaced relation to the bottom wall to position the unthreaded section between the second threaded section and the bottom wall.

48. The cylindrical lock of claim 40, wherein the pushing means includes a plunger abutting the spring and means for moving the plunger against the spring to move the locking means to its handle-locking position.

49. The cylindrical lock of claim 48, wherein the pushing means includes motor means for moving the plunger relative to the locking means against the spring.

50. The cylindrical lock of claim 49, wherein the motor means includes a motor, a rotatable motor drive shaft, and a spindle, and the spindle includes a distal end threadingly engaging the plunger and socket means for converting rotation of the motor drive shaft into rotation of the spindle.

* * * * *